US006193641B1

(12) United States Patent
Barker

(10) Patent No.: US 6,193,641 B1
(45) Date of Patent: Feb. 27, 2001

(54) APPARATUS FOR FOLDING AND SEALING A SHEET HAVING PRESSURE SENSITIVE ADHESIVE POSITIONED THEREON

(76) Inventor: Donald Barker, 8 Mountain Laurel La., Sandy Hook, CT (US) 06482

( * ) Notice: Subject to any disclaimer, the term of this patent is extended or adjusted under 35 U.S.C. 154(b) by 0 days.

(21) Appl. No.: 09/291,451

(22) Filed: Apr. 14, 1999

(51) Int. Cl.[7] ..... B31F 7/00

(52) U.S. Cl. ..... 493/420; 493/264; 493/419; 493/434

(58) Field of Search ..... 493/419, 420, 493/434, 432, 917, 264, 403; 53/374.4

(56) References Cited

U.S. PATENT DOCUMENTS

| | | | | |
|---|---|---|---|---|
| 1,863,709 | * | 6/1932 | Beal | 493/419 |
| 3,747,917 | * | 7/1973 | Roda | 493/419 |
| 4,270,909 | * | 6/1981 | Ireland | 493/420 |
| 5,048,809 | * | 9/1991 | Tebbe et al. | 493/420 |
| 5,129,876 | * | 7/1992 | Brabant et al. | 493/419 |
| 5,180,151 | * | 1/1993 | Branecky et al. | 493/420 |
| 5,290,225 | * | 3/1994 | Younger | 493/264 |
| 5,437,596 | * | 8/1995 | Bogdan et al. | 493/420 |
| 5,514,066 | * | 5/1996 | Monaco | 493/420 |
| 5,683,338 | * | 11/1997 | Krasuski et al. | 493/420 |
| 5,904,644 | * | 5/1999 | Dronsfield | 493/420 |
| 5,946,889 | * | 9/1999 | Baker et al. | 53/374.4 |

* cited by examiner

*Primary Examiner*—Peter Vo
*Assistant Examiner*—Louis X. Huynh
(74) *Attorney, Agent, or Firm*—Melvin I. Stoltz

(57) ABSTRACT

An apparatus for folding and sealing a sheet having a pressure sensitive adhesive positioned thereon is disclosed. The apparatus includes a first roller and a second roller. The second roller has a roller surface, and a plurality of independent sealing protrusions extending from the roller surface. The sealing protrusions are positioned in operative contact with the first roller during advancement of the sheet between the first roller and the second roller. The apparatus yet further includes a third roller. The sealing protrusions of the second roller are positioned in operative contact with the third roller during advancement of the sheet between the second roller and the third roller. The sealing protrusions extend from the roller surface at locations such that advancement of the sheet between the second roller and the third roller causes the sealing protrusions to operatively contact the adhesive.

11 Claims, 11 Drawing Sheets

APPARATUS FOR FOLDING AND SEALING A SHEET HAVING PRESSURE SENSITIVE ADHESIVE POSITIONED THEREON

TECHNICAL FIELD OF THE INVENTION

The present invention relates in general to an apparatus for folding a sheet of paper, and in particular, to an apparatus and method for folding and sealing a sheet having pressure sensitive adhesive positioned thereon.

BACKGROUND ART

During the last few decades substantial effort has been expanded in developing folding systems for providing improved automation in handling and processing large volumes of repetitively produced printed material. In particular, industries, such as utilities, repeatedly produce and distribute large volumes or runs of monthly bills or statements which must be inserted in envelopes, sealed and mailed. In addition, numerous other businesses have similar large printing requirements for monthly distribution of invoices, checks, and the like. Furthermore, many business organizations distribute large quantities of pre-printed letters, advertisements, and the like, all of which must be folded inserted in envelopes and mailed.

In spite of the expanding demand for folding systems which would reduce the manual labor involved in handling these large volume production runs of printed material, no folding systems have been achieved which are capable of fully satisfying all of the needs and the demands of these different industries. In particular, no prior art system has achieved a universally applicable folding and sealing system capable of receiving pre-printed sheets of material having adhesive zones and folding the sheets of material into a configuration which produces a final product which emulates a conventional envelope. At best, some prior art systems have achieved folding systems for capturing material therein. However, these prior art systems produce sealed envelope-shaped products which are incapable of visually simulating a conventional envelope and typically incorporate opening strips which are difficult for consumers to use in order to gain access to the contents of the envelope.

In a typical prior art system, the folding apparatus places two folds in a sheet of paper. In order to place the first fold in the sheet of paper, the sheet is fed in from a paper source through a pair of feed rollers into a first chute. The sheet advances until it contacts a first sheet stop. As the midsection of the sheet continues to advance, the sheet buckles away from the first chute. The buckle then comes into contact with and is fed through a pair of intermediate rollers which fold the sheet at the buckle.

To place a second fold in the sheet of paper, the sheet is advanced from the intermediate pair of rollers into a second chute. The paper advances until it contacts a second sheet stop. As the midsection of the sheet continues to advance, the sheet buckles away from the second chute. The buckled portion of the sheet then comes into contact with and is fed through a pair of exit rollers which fold the sheet at the second buckle. Typically, one of the feed rollers and one of the exit rollers form the intermediate pair of rollers. Thus, the folding apparatus requires a total of four rollers.

If it is desired to seal the folded sheet of paper, that is, bond the sheet of paper to itself such that the sheet cannot readily be unfolded without breaking the bond, the sheet of paper is subsequently advanced through a set of sealing rollers. The sealing rollers compress the folded sheet such that an adhesive positioned on the sheet can seal the folded sheet of paper. The adhesive can either be heat activated, which requires the sheet to be heated by a heating element prior to being advanced through the sealing rollers. Alternately, the adhesive can be pressure sensitive which requires that the sealing rollers exert a high pressure on the folded sheet of paper as it passes through the sealing rollers.

A problem with folder and sealing apparatus heretofore designed is that the sealing rollers add cost and complexity to the folding apparatus as well as increasing the size of the folding apparatus. In addition to the two sealing rollers, a heating unit must be employed to activate heat activated adhesive. Alternately, a biasing device must be employed to supply the force necessary to activate pressure sensitive adhesives. In addition, the sealing rollers must be driven either by the motor that rotates the other rollers, or by a separate motor. In either case, a larger motor or an additional motor as well as the additional components undesirably increases the cost and size of the folding apparatus.

In addition, the pressure required to bond the sheet of paper to itself using pressure sensitive adhesives can be quite high, thus necessitating that a large force be maintained between the two sealing roller. This large force increases the rolling resistance between the sealing rollers which increases the amount of power required to operate the sealing rollers. Thus, the large sealing force requires a relatively large and expensive motor and power supply.

Therefore, it is a principal object of the present invention to provide a fully integrated system for receiving pre-printed sheets and folding and sealing the sheets into an envelope configuration.

Another object of the present invention is to provide a sheet folding and sealing system having the characteristic features described above which requires a minimum number of components and employs low power, an inexpensive motor, and smaller power supply.

A further object of the present invention is to provide a sheet folding and sealing system having the characteristic features described above which has a new and useful construction for folding and sealing sheets of paper and produces securely folded and sealed final products.

Another object of the present invention to is to provide a sheet folding and sealing system having the characteristic features described above which is relatively inexpensive to manufacture.

Another object of the present invention is to provide a sheet folding and sealing system having the characteristic features described above which is durable.

A further object of the present invention is to provide a sheet folding and sealing system having the characteristic features described above which is capable of long-term continuous use without manual intervention.

Another object of the present invention is to provide a sheet folding and sealing system having the characteristic features described above which smaller in size.

Another object of the present invention is to provide a sheet folding and sealing system having the characteristic features described above which does not require a relatively large and expensive motor and power supply.

Other and more specific objects of the present invention will become apparent from the following description and attached drawings.

SUMMARY OF THE INVENTION

By employing the present invention, all of the difficulties and drawbacks of the prior art have been overcome, and a fully integrated system is attained for folding and sealing a sheet having a pressure sensitive adhesive positioned thereon. The apparatus incorporated into the system of this invention includes a first roller and a second roller. The second roller has a roller surface and a sealing protrusion extending from the roller surface. The sealing protrusions are positioned in operative contact with the first roller during advancement of the sheet between the first roller and the second roller and form a contact area with the first roller which is 20% or less than the contact area for the entire second roller. The apparatus further includes a sheet stop positioned to halt forward movement of the sheet during advancement of the sheet between the first roller and the second roller. The apparatus yet further includes a third roller. The sealing protrusion of the second roller is positioned in operative contact with the third roller during advancement of the sheet between the second roller and the third roller. The sealing protrusion extends from the roller surface at a location such that advancement of the sheet between the second roller and the third roller causes the sealing protrusion to operatively contact the adhesive.

In accordance with the present invention, the apparatus is constructed for folding and sealing a sheet having a pressure sensitive adhesive positioned thereon. The apparatus includes a first roller and a second roller. The first roller has a roller surface and a sealing protrusion extending from the roller surface. The apparatus further includes a sheet stop positioned to halt forward movement of the sheet and subsequently create a buckle in the sheet which is advanced into a roller nip defined by the first roller and the second roller. The sealing protrusion is positioned in operative contact with the first roller during advancement of the sheet between the first roller and the second roller. The sealing protrusion extends from the roller surface at a location such that advancement of the sheet between the first roller and the second roller causes the sealing protrusion to operatively contact the adhesive.

The present invention also comprises alternate constructions for forming the annular rings or sealing protrusions which are formed on the second roller. In order to provide the desired automated folding and sealing of sheets of paper into a folded envelope configuration, stringent controls and limitations must be imposed upon the annular rings.

In this regard, the distance each annular ring protrudes from the roller surface must be tightly controlled, as well as the width of each ring and the spacing between rings. All of these factors combine to achieve a unique construction.

In addition, the present invention may also be employed to fold and seal sheets of paper having different folding requirements which produce different thicknesses. In order to accommodate these alternate and competing demands, the annular rings employed in the roller of the present invention may be formed using compressible material, either partially or entirely. In this way, folded sheets resulting in different thicknesses in the same product are able to be easily processed without difficulty.

Finally, in accordance with the present invention, a separate, self-standing, easily employed, folding machine is attained for receiving printed sheets from a cassette or stack. Although the principal folding system of this invention is defined in association with a printer, an independent, stand-alone folding system is also attainable due to the unique construction features of this invention.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the nature and objects of the present invention, reference should be made to the following detailed description taken in connection with the accompanying drawings, in which.

DETAILED DESCRIPTION OF THE INVENTION

Figure 1:
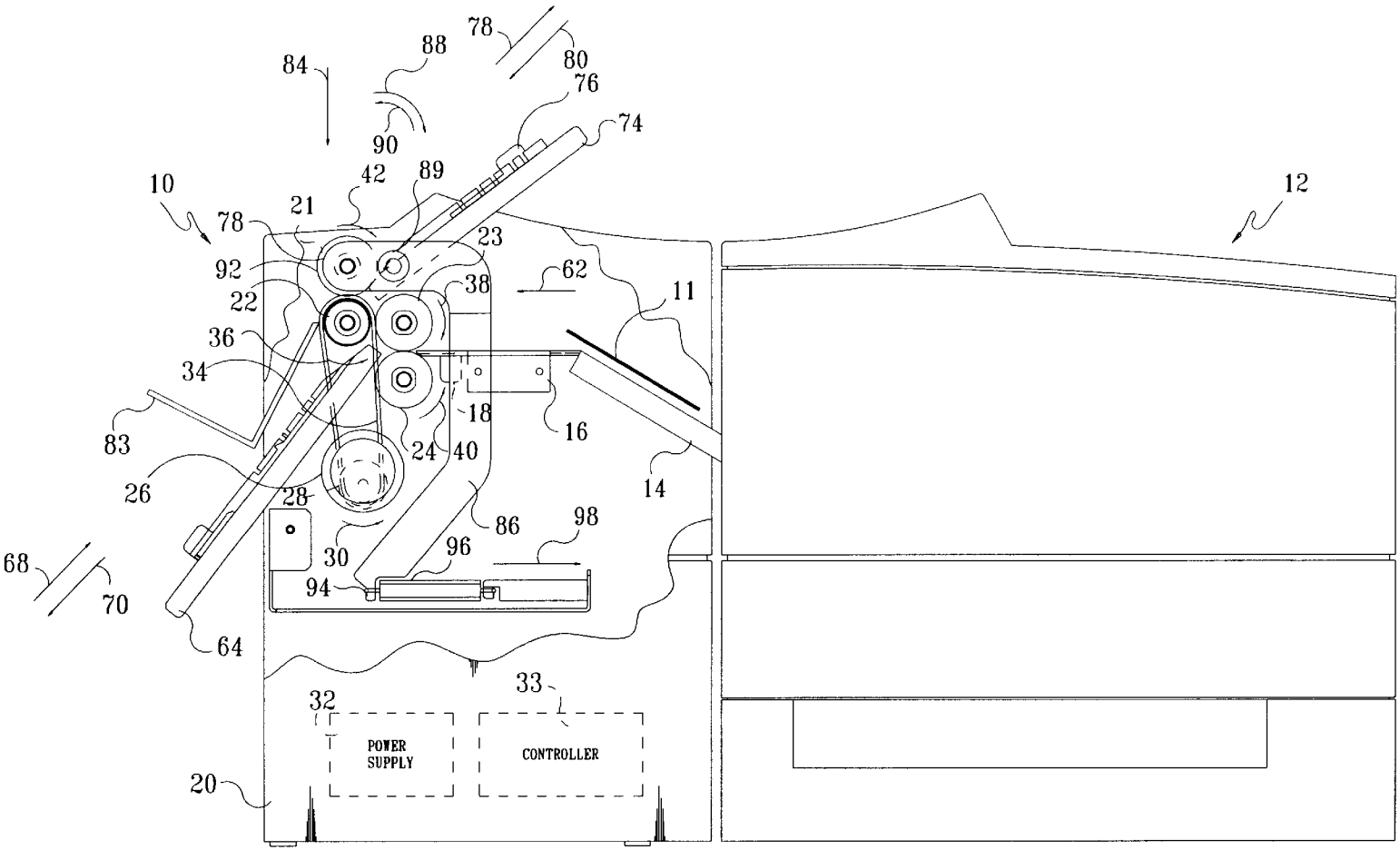
FIG. 1 is a partially cut away side elevation view of the folder and sealer apparatus and printer, which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown the folder-sealer assembly 10 of the present invention. The folder-sealer assembly 10 is configured to receive a sheet of paper 11 which exits a printer 12. In particular, the sheet 11 exits the printer 12 via a printer discharge tray 14 after the printer 12 has printed information on the sheet 11. From the discharge tray 14, the sheet 11 advances to a feed tray 16. The feed tray 16 is secured to a frame 20 which supports the various components of the folder-sealer assembly 10. The feed tray 16 is operable to position and align the sheet 11 before the sheet 11 is folded and sealed. A photo sensor 18 is positioned in the feed tray 16 and is operable to generate a sheet position signal when the sheet 11 is positioned above photo sensor 18 on the feed tray 16.

The folder-sealer assembly 10 further includes an electric motor 26. The electric motor 26 includes a drive wheel 28 that rotates in the general direction of arrow 30 upon receipt of a motor control signal. The drive wheel 28 advances a drive belt 34 in the general direction of arrow 30. Upon receipt of the motor control signal, electric power is supplied to the electric motor 26 by an electrical power supply 32 so as to cause the drive wheel 28 and the drive belt 34 to advance in the general direction of arrow 30.

The folder-sealer assembly 10 further includes a controller 33 which is operative to receive sheet position signals from the photo sensor 18 and generate motor control signals in response thereto. In particular, upon receipt of the sheet position signal, the controller 33 determines the timing and duration of the motor control signal which controls the operation of the electric motor 26.

The folder-sealer assembly 10 further includes a roller 21, a roller 22, a roller 23, and a roller 24. Each of the roller 21, the roller 22, the roller 23, and the roller 24 are rotatably secured to the frame 20. As the drive belt 34 advances in the general direction of arrow 30, the drive belt 34 engages the roller 22 so as to cause the roller 22 to rotate in the general direction of arrow 36. The roller 22 and the roller 23 are coupled to each other by a first pair of drive gears (not shown) such that rotation of the roller 22 in the general direction of arrow 36 causes the roller 23 to rotate in the general direction of arrow 38. Similarly, the roller 23 and the roller 24 are coupled to each other by a second pair of drive gears (not shown) such that rotation of the roller 23 in the general direction of arrow 38 causes the roller 24 to rotate in the general direction of arrow 40. Moreover, the roller 22 and the roller 21 are coupled to each other by a third pair of drive gears (not shown) such that rotation of the roller 22 in the general direction of arrow 36 causes the roller 21 to rotate in the general direction of arrow 42.

Figure 2:
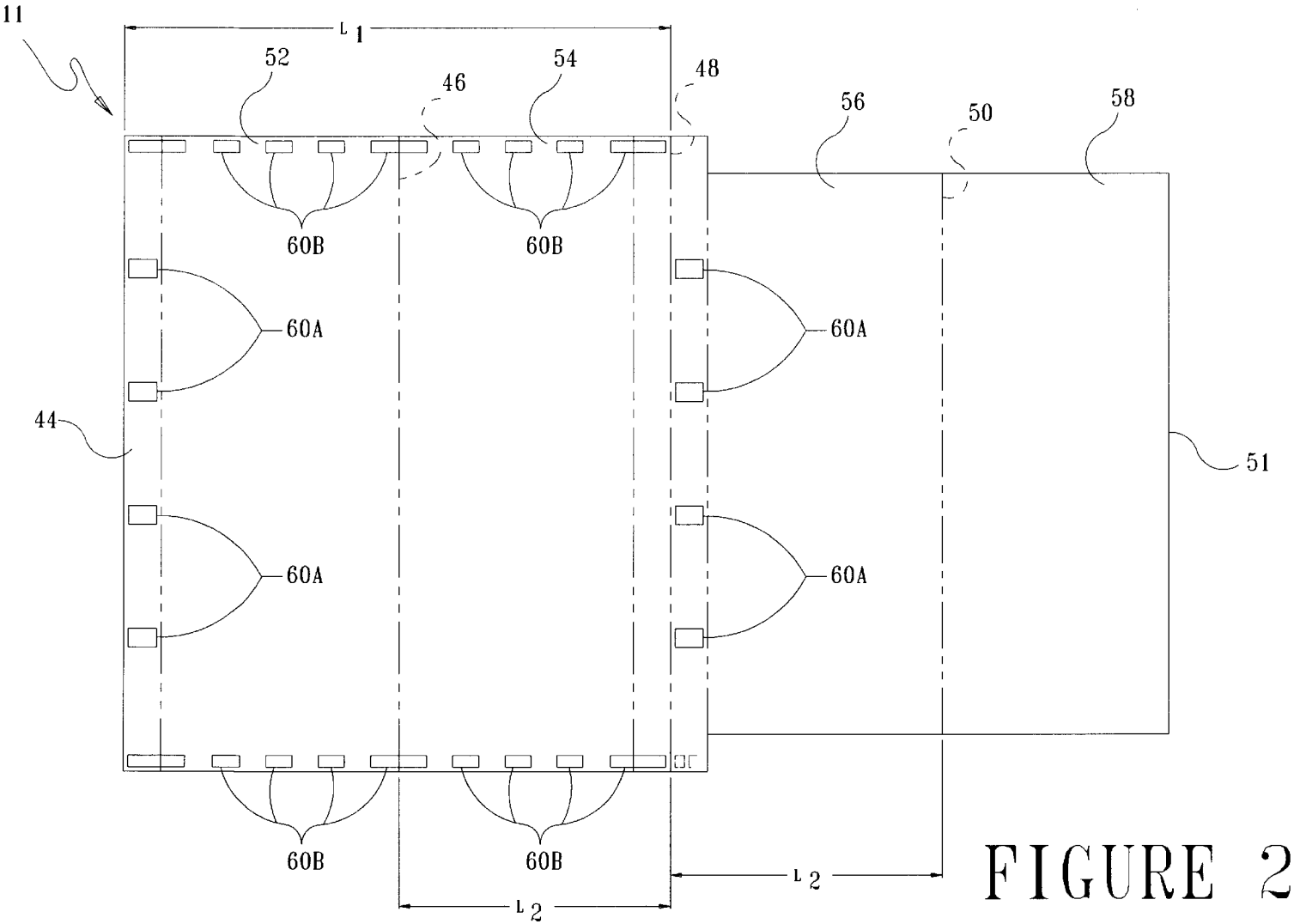
FIG. 2 is a top elevational view of a sheet of paper which is folded and sealed in the apparatus of FIG. 1, note that pressure sensitive adhesive material is placed on the sheet of paper.

Referring now to FIG. 2, there is shown the sheet 11 in greater detail. The sheet 11 includes a leading edge 44, a first perforated line 46, a second perforated line 48, a third perforated line 50, and a trailing edge 51. The leading edge 44 and the first perforated line 46 define a first sheet segment 52. The first perforated line 46 and the second perforated line 48 define a second sheet segment 54. The second perforated line 48 and the third perforated line 50 define a third sheet segment 56. The third perforated line 50 and the trailing edge 51 define a fourth sheet segment 58. The sheet 11 further includes a number of patches 60A and 60B where a pressure sensitive adhesive has been applied. One such pressure sensitive adhesive which may be used with the present invention is a pressure activated co-adhesive which is available from Moore North America of Toronto, Canada as either standard or enhanced chemistry pressure activated co-adhesive.

Figure 3A:
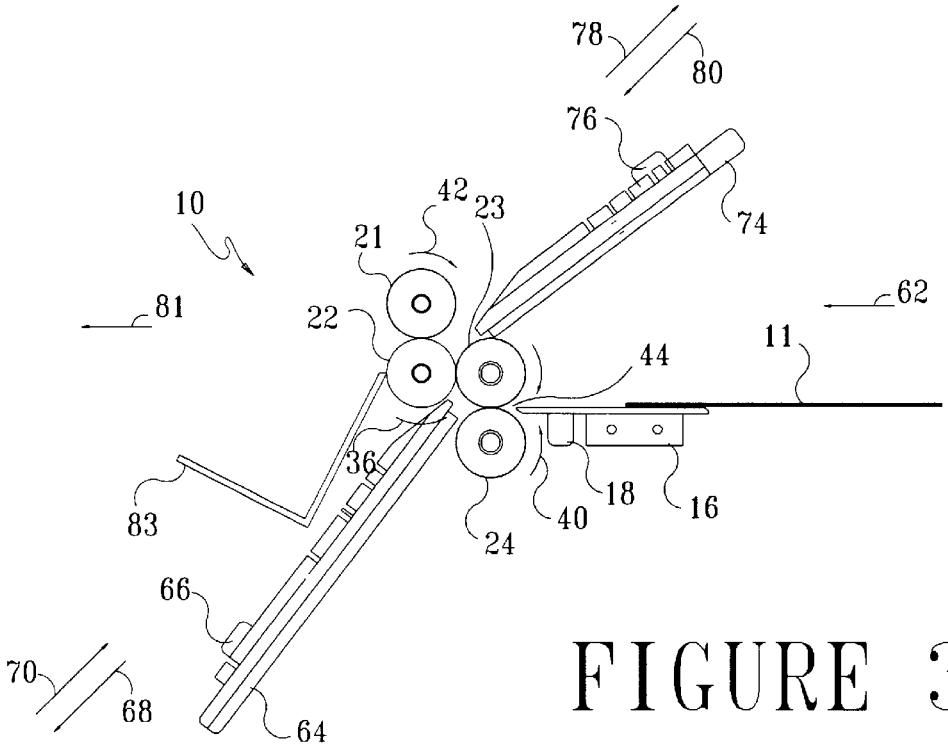
FIG. 3A is a schematic view of the folder and sealer apparatus showing the sheet of paper being advanced between the first feed roller and the second feed roller.

Referring now to FIG. 3A, there is shown the sheet 11 positioned on the feed tray 16. The sheet 11 is advanced in the general direction of arrow 62 by the rollers (not shown) of the printer 12. As the sheet 11 advances in the general direction of arrow 62, the sheet 11 passes over the photo sensor 18 which generates a paper position signal. Upon receipt of the paper position signal, the controller delays generating a motor control signal for a first time period. The first time period allows the rollers in the printer 12 sufficient time to advance the sheet 11 into the roller 23 and the roller 24 so as to assure that the sheet 11 is squared against the roller 23 and roller 24 prior to being advanced between the roller 23 and the roller 24. After the first time period, the control unit 33 generates a motor control signal which activates the motor 26 thereby causing the roller 23 to rotate in the general direction of arrow 38 and causing the roller 24 to rotate in the general direction of arrow 40. The roller 23 and the roller 24 are in operative contact with each other. What is meant herein as operative contact is that both the roller 23 and the roller 24 cooperate to advance the sheet 11 in the general direction of arrow 62. Thus, as the roller 23 rotates in the general direction of arrow 38 and the roller 24 rotates in the general direction of arrow 40, the sheet 11 is advanced between the roller 23 and roller 24 in the general direction of arrow 62.

Figure 3B:
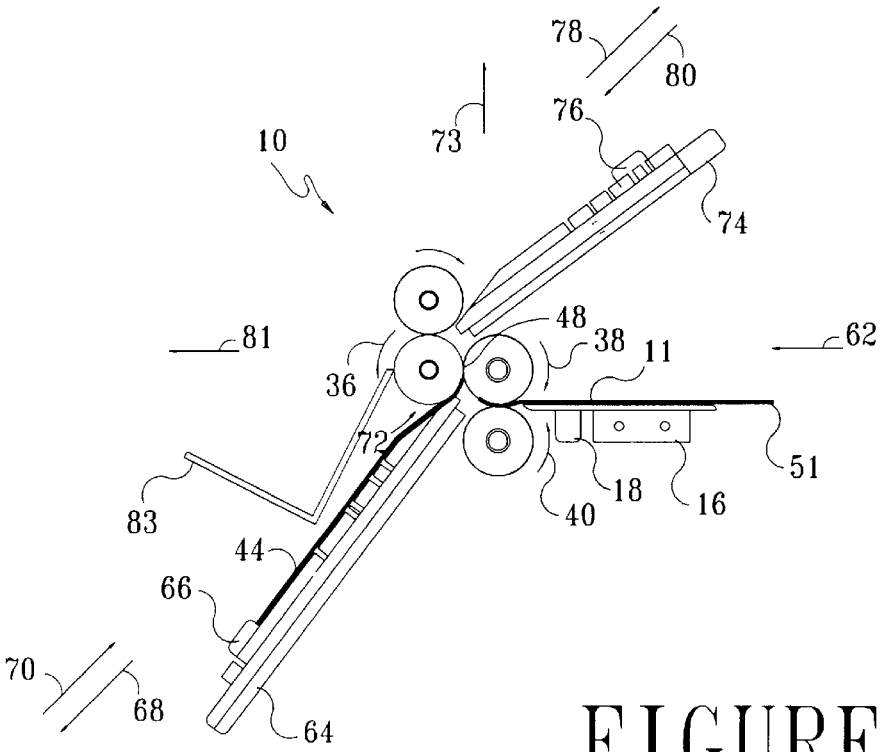
FIG. 3B is a view similar to FIG. 3A, but showing a first fold being formed in the sheet of paper.

Referring now FIG. 3B, the folder-sealer assembly 10 further includes a first chute 64 positioned to receive the sheet 11 after it exits the roller 23 and the roller 24. A first sheet stop 66 is positioned to halt the advance of the sheet 11 in the general direction of arrow 68. After the leading edge 44 of the sheet 11 comes into contact with the first sheet stop 66, the leading edge 44 does not continue advance in the general direction of arrow 68. As the roller 23 and the roller 24 continue to advance the sheet 11 in the general direction of arrow 62, the sheet 11 begins to buckle at the second perforated line 48.

As the roller 23 and the roller 24 continue to rotate, the buckle at the second perforated line 48 advances in the general direction of arrow 73 toward a nip 72 formed by the roller 22 and the roller 23. The roller 22 and the roller 23 are in operative contact with each other such that as the roller 22 rotates in the general direction of arrow 36 and the roller 23 rotates in the general direction of arrow 38, the buckle at the second perforated line 48 is advanced between the roller 22 and the roller 23 in the general direction of arrow 73 so as to create a first fold in the sheet 11.

A distance L1 (shown in FIG. 2) between the leading edge 44 and the second perforated line 48 must correspond to the distance between the first stop 66 and the nip 72 defined by the roller 22 and the roller 23. To this end, the first stop 66 is adjustable in the general direction of arrows 68 and 70. This adjustment allows the first chute 64 to be configured to cause the sheet 11 to buckle at any one of various distances from the leading edge 44 of the sheet 11.

Figure 3C:
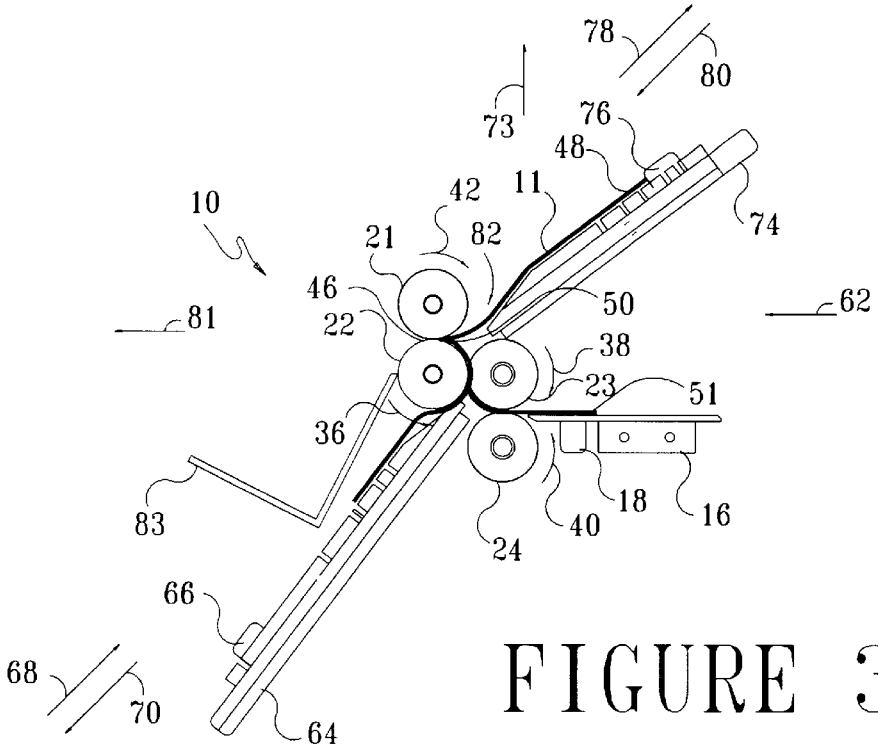
FIG. 3C is a view similar to FIG. 3A, but showing a second fold being formed in the sheet of paper and the folded sheet being sealed.
Figure 3D:
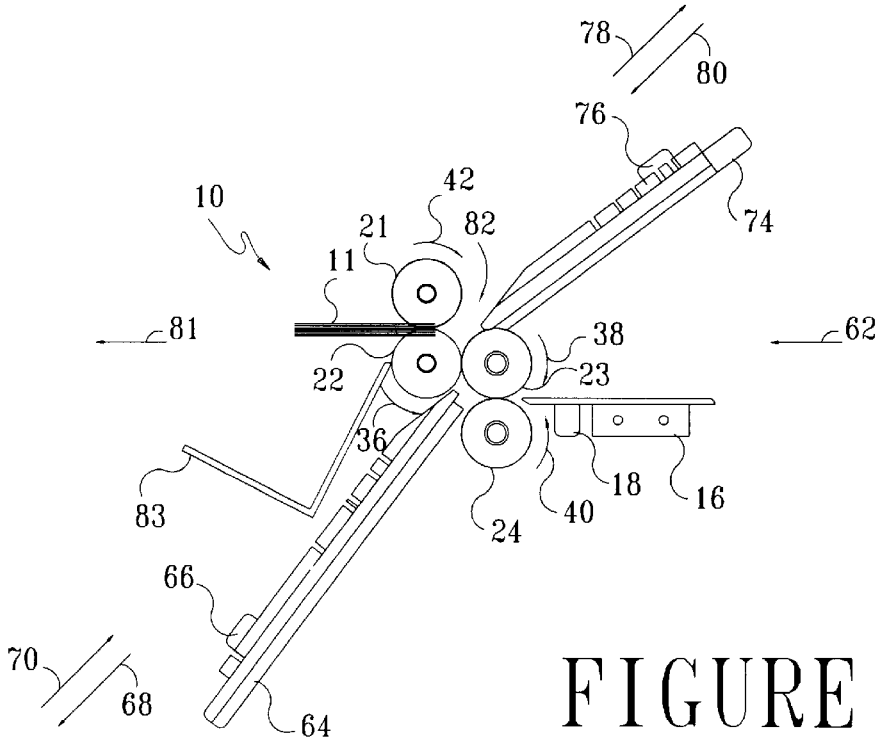
FIG. 3D is a view similar to FIG. 3C, but further showing the second fold being formed and the folded sheet being sealed.

Referring now to FIGS. 3C and 3D, the folder-sealer assembly 10 further includes a second chute 74 positioned to receive the sheet 11 after it exits the roller 22 and the roller 23. A second sheet stop 76 is positioned to halt the advance of the sheet in the general direction of arrow 78. After the fold at the second perforated line 48 of the sheet 11 comes into contact with the second sheet stop 76, the sheet 11 does not continue to advance in the general direction of arrow 78. As the roller 22 and the roller 23 continue to advance the sheet 11 in the general direction of arrow 73, the sheet 11 begins to buckle in two locations: (i) along the first perforated line 46 and (ii) along the third perforated line 50.

The buckle at the first perforated line 46 and the buckle at the third perforated line 50 advance between a nip 82 formed by the roller 21 and the roller 22. It should be appreciated that the roller 21 and the roller 22 are in operative contact with each other such that as the roller 21 rotates in the general direction of arrow 42 and the roller 22 rotates in the general direction of arrow 36, the buckle at the first perforated line 46 and the buckle at the third perforated line 50 advance between the roller 21 and the roller 22 in the general direction of arrow 81 so as to create a second fold in the sheet 11 at the first perforated line 46 and the third perforated line 50.

A distance L2 (shown in FIG. 2) between the first perforated line 46 and the second perforated line 48 must correspond the distance between the second sheet stop 76 and the nip 82 defined by the roller 21 and the roller 22. Similarly, the distance L2 between the second perforation 48 and the third perforated line 50 must correspond the distance between the second stop 76 and the nip 82 defined by the roller 21 and the roller 22. To this end, the second sheet stop 76 is adjustable in the general direction of arrows 78 and 80. This adjustment allows the second chute 74 to be configured to place the second fold in the sheet 11 at any one of a number of distances from the second perforated line 48 of the sheet 11.

Referring again to FIG. 3C, as the trailing edge 51 of the sheet 11 advances in the general direction of arrow 62, the trailing edge of the sheet 11 passes beyond the photo sensor 18 which causes the photo sensor 18 to cease generating the paper position signal. Upon cessation of the paper position signal, the controller delays for a second time period. The delay for the second time period allows sufficient time for the sheet 11 to pass through the roller 21 and the roller 22 (see FIG. 3D) to an exit bin 83 which holds the finished folded sheet 11 (see FIG. 3E). After the second time period, the control unit 33 ceases to generate the motor control signal which causes the motor 26 to cease to rotate the drive wheel 28 which stops the rotation of the roller 21, the roller 22, the roller 23, and the roller 24.

Referring again to FIG. 1, to seal the sheet 11 as the second fold is placed in the sheet 11, a sealing pressure, on the order of 350 pounds per linear inch, must be exerted on the patches 60A and 60B (see FIG. 2) to activate the pressure sensitive adhesive. To supply the sealing pressure, the roller 21 is biased toward the roller 22 in the general direction of arrow 84. To supply the bias force, a lever arm 86 is rotatably secured to the frame 20 by a pin 89 such that the lever arm 86 can pivot in the general direction of arrows 88 and 90 about the pin 89. It should be appreciated that a second lever arm (not shown) is secured to the opposite side of the frame 20 and is substantially identical to the pivot arm 86 described herein.

The roller 21 is rotatably secured to a first end 92 of the lever arm 86, whereas a second end 94 of the lever arm 86 is secured to a spring 96. The spring 96 is interposed between the second end 94 of the lever arm 86 and the frame 20. The spring 96 supplies a bias force to the lever arm 86 in the general direction of arrow 98 which causes the lever arm 86 to rotate about the pin 89 in the general direction of arrow 90. As the lever arm 86 rotates in the general direction of arrow 90, the first end 92 and the roller 21 are urged in the general direction of arrow 84 toward the roller 22.

As depicted, lever arm 86 preferably comprises a shape which resembles the numeral "7". In this way, it has been found that lever arm 86 imparts a seven to one mechanical advantage to spring 96. As a result, the overall size of folder-sealer assembly 10 is substantially reduced while the force of the roller 21 acting on the roller 22 in the general direction of arrow 84 is approximately seven times the force of the spring 96 acting in the general direction of arrow 98.

Figure 4:
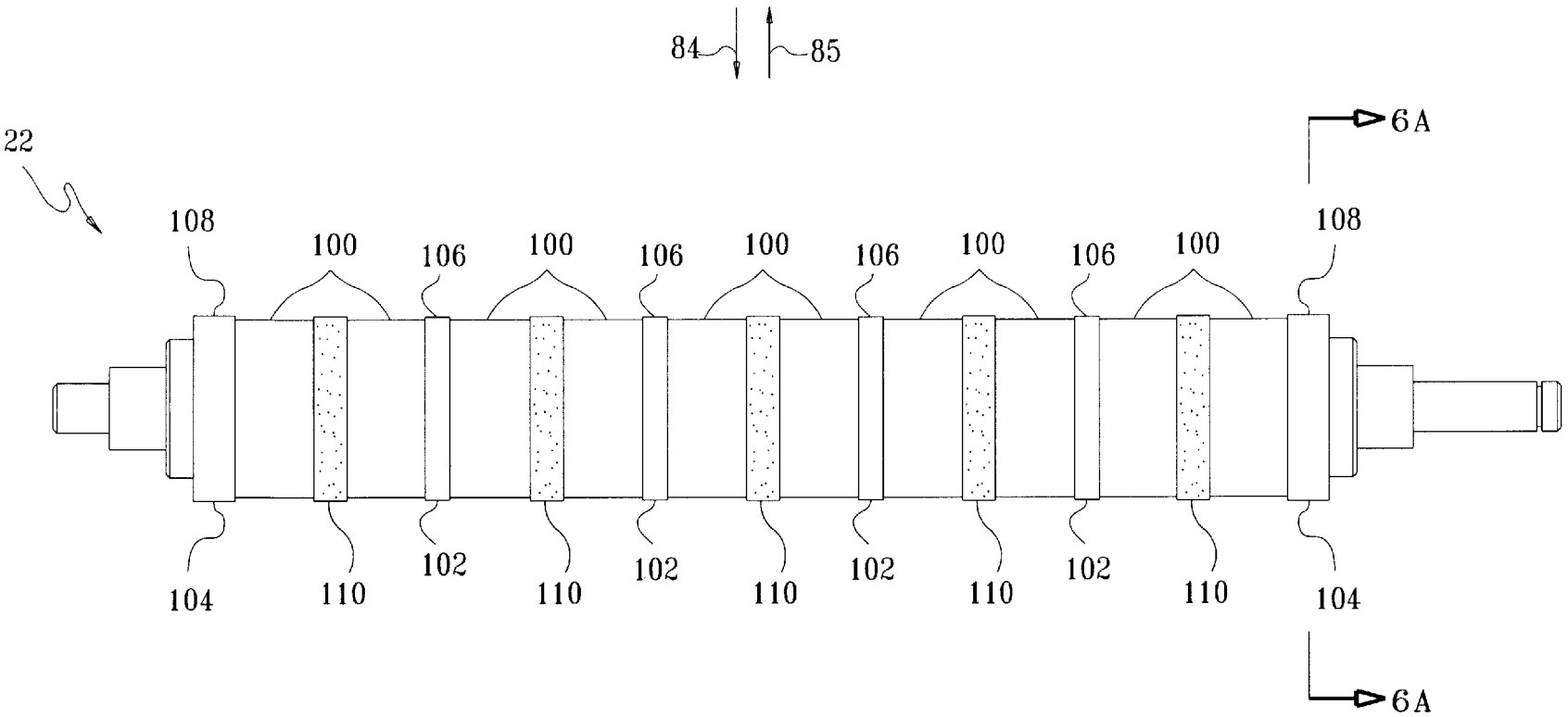
FIG. 4 is a front elevational view of the second roller showing the raised annular rings.

Referring now to FIG. 4, there is shown the roller 22 in more detail. The roller 22 includes a roller surface 100 which extends along the length of the roller 22, The roller 22 further includes a number of inner annular rings 102 and two outer annular rings 104 which protrude radially from the surface of the roller surface 100. Each of the inner annular rings 102 defines a sealing surface 106, whereas each of the outer annular rings 104 defines a sealing surface 108. The sealing surfaces 106 are preferably formed from steel, while the sealing surfaces 108 are preferably formed in a manner which enables sealing surfaces 108 of outer sealing rings 106 to be compressible, when required, as well as being resistant to compression under other requirements. As fully detailed below, the dual function is best attained by forming sealing surfaces 108 from a hard urethane or forming sealing surfaces 108 from steel which preferably surrounds a hard urethane core. One hard urethane that may be used in these alternate constructions for sealing surface 108 in the present invention is available from Mearthane Products of Cranston, R.I. as 60 Shore D urethane.

As the sheet 11 passes between the roller 21 and the roller 22, the sealing surfaces 106,108 of the roller 22 are in operative contact with the roller 21 (see FIG. 3D). In particular the patches 60A (see FIG. 2) on the sheet 11 are advanced between the sealing surfaces 106 of the inner annular rings 102 and the roller 21 whereas the patches 60B (see FIG. 2) on the sheet 11 are advanced between the sealing surfaces 108 of the outer annular rings 104 and the roller 21. It should be appreciated that because the force of the roller 21 is concentrated on only the sealing surfaces 106, 108 of the roller 22, the sealing pressure on the sealing surfaces 106, 108 is substantially greater than pressure possible if the roller 22 did not have the annular rings 102, 104 protruding from the roller 100. By applying the sealing pressure to the patches 60A and 60B, the patches 60A and 60B adhere to the adjacent surfaces of the sheet 11 so as to seal the sheet 11 as the second fold is formed in the sheet 11 (see FIG. 3D).

By employing roller 22 of this invention, the amount of force required from roller 21 on roller 22 in the general direction of arrow 84 is significantly reduced over the force required to produce the sealing pressure along the entire length of the roller 22. In this way, by reducing the amount of force between the roller 21 and the roller 22 which is necessary to seal the sheet 11, the amount of power that motor 26 must supply to rotate the roller 21 and the roller 22 is also reduced. By reducing the amount of power required, the folder-sealer assembly 10 can employ a smaller, less expensive motor 26 and power supply 32. However, in addition to the desirability of providing sufficient sealing force in the desired areas with reduced power requirements, the force imposed between rollers 21 and 22 and the contact area therebetween must be sufficient to impart a uniform, crisp fold edge to sheet 11 which extends the entire length of sheet 11. This result is best achieved by maximizing the contact area. By employing the unique configuration of the present invention, these competing requirements are fully satisfied, and a roller system is attained which provides a uniform, crisp, fully extending folded edge while minimizing the motor size and power needs and securely sealing the pre-applied adhesive zones formed on sheet 11.

One of the principal unique discoveries of the present invention is the construction of roller 22 with radially extending annular rings 102 and 104 with sealing surfaces 106 and 108 comprising a total contact area ranging between about 10% and 20% based upon the entire length of roller 22. Furthermore, it has also been discovered that optimum results are attained with the contact area ranging between about 12% and 18.5%.

By employing roller 22 with this construction, it has been found that the size of the motor required to operate the system is substantially reduced, and all adhesive patches 60A and 60B of sheet 11 are securely activated with every folded edge comprising a clean, crisp, secure, tight folded configuration. These desirable results are attained by forming annular rings 102 and 104 with the contact areas defined above and, in the preferred embodiment, with the width of each sealing surface 106 of each inner annular ring 102 ranges between about 0.150 inches and 0.250 inches while the width of each sealing surface 108 of each outer annular ring ranges between about 0.225 and 0.325 inches. By properly balancing these various factors, roller 22 of the present invention is attained and all of the desired results are realized.

The final factor employed in constructing roller 22 of this invention is the number of inner annular rings 102 which are employed in addition to the two outer annular rings 104. In the preferred embodiment, as depicted, four annular rings 104 are formed on roller 22. Although a usable roller 22 can be achieved with two or three inner annular rings 102, a total of four separate and independent annular rings 102 are preferred.

Regardless of the total number of annular rings 102 and 104 which are employed, the annular rings are spaced apart on roller surface 100 in a manner which provides an equal spaced distance between each adjacent annular ring. By employing this construction, the creation of complete, crisp, fully creased folded edge is realized. In this regard, it has been found that even though sheet 11 does not contact roller 22 along its entire length, the contact of sheet 11 with roller 21 and the annular rings of roller 22 achieves a fold line which is virtually indistinguishable from a fold line created by two rollers whose entire surfaces are in contact with each other.

By constructing roller 22 in the manner detailed above, incorporating all of the parameters and limitations discussed, roller 22 is achieved which provides all of the desired attributes and achievements defined herein. However, by reducing the effective contact area between roller 21 and roller 22, difficulty may be encountered in frictionally engaging shaft 11 in the nip of the cooperating rollers. In order to overcome this difficulty, various methods may be employed.

In one embodiment, the surface of roller 21 or roller surface 100 may be roughened to establish a high friction surface for grabbing sheet 11. Alternatively, in order to increase the frictional force used to draw the sheet 11 into the nip 72, roller 22 includes a number of sheet grippers 110 positioned between the annular rings 102,104. Each sheet gripper 110 is an elastomeric member that extends around the roller surface 100 of the roller 22 and is composed of soft urethane. One soft urethane that may be used in the present invention is available from Mearthane Products of Cranston, R.I. as 65 Shore A urethane. The sheet grippers 110 extend radially beyond the sealing surfaces 106, 108 such that the sheet grippers 110 come into contact with the sheet 11 and advance the sheet 11 toward the nip 82 between the roller 21 and the roller 22. In addition, the soft urethane of the sheet gripper 110 compresses to allow the sealing surfaces 106 and 108 to be placed in operative contact with the roller 21 as the sheet 11 is advanced between the roller 21 and the roller 22.

Referring again to FIG. 2, the patches 60A are placed in locations where the paper is four layers thick as the sheet 11 is advanced through the roller 21 and the roller 22, whereas the patches 60B are placed in locations where the sheet 11 is only 2 layers thick as the sheet 11 is advanced between the roller 21 and the roller 22. In particular, the patches 60A are aligned with a portion of the paper which will include the first sheet segment 52, the second sheet segment 54, the third sheet segment 56, and the fourth sheet segment 58. On the other hand, the patches 60B are aligned with a portion of the sheet 11 which includes the first sheet segment 52 and the second sheet segment 54. Therefore, the sealing surfaces 108 of the outer annular rings 104 must preferably extend radially beyond than the sealing surfaces 106 of the inner annular rings 102 to compensate for the varying thickness of the folded sheet 11.

Figure 9:
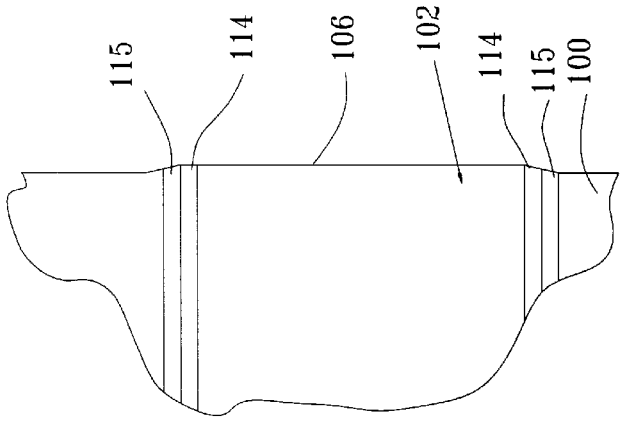
FIGS. 7, 8 and 9 are fragmentary views of an alternate preferred embodiment for forming the annular rings on the second roller.
Figure 8:
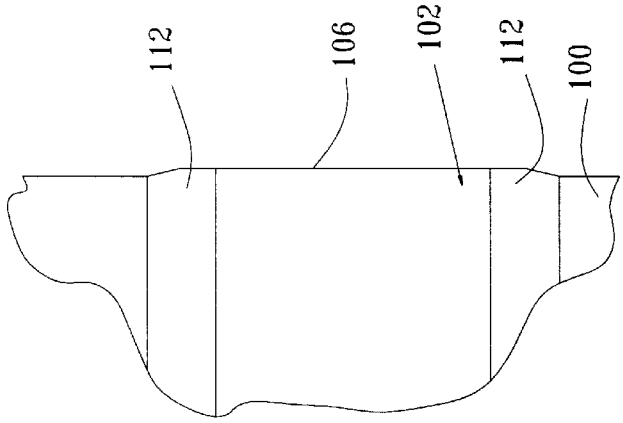
Figure 7:
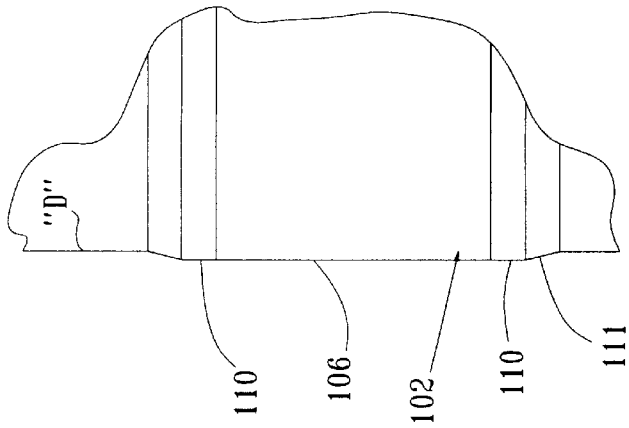

In order to achieve the desired result of effectively sealing all adhesive patches 60A and 60B regardless of the different layers of material involved during the sealing process, it has been found that each sealing surface 106 of each inner annular ring 102 is preferably spaced away from shaft surface 100 by a distance ranging between about 0.005 and 0.015 inches. This distance is shown in FIGS. 7, 8 and 9 as distance "D". In addition, each sealing surface 108 of each outer annular ring 104 is preferably spaced from shaft surface 100 by a distance ranging between about 0.015 and 0.025 inches. In the preferred embodiment, each sealing surface 106 of each annular ring 102 is spaced away from shaft surface 100 by a distance substantially equivalent to 0.010 inches, while each sealing surface 108 of each outer annual rings 104 is spaced from shaft surface 100 by a distance substantially equal to 0.020 inches. By employing this construction, the desired attributes detailed above for roller 22 are obtained.

Another feature incorporated into roller 22 of the present invention is employed to eliminate any tracks or creases on sheet 11 which are caused by annular rings 102 as the rings contact sheet 11 while sheet 11 passes between roller 22 and roller 21. In order to eliminate the presence of any such creases or tracks, each annular ring 102 incorporates smoothly, blended, beveled, sloping and/or rounded edges, as depicted in FIGS. 7, 8 and 9.

In FIG. 7, sealing surface 106 is shown spaced away from shaft surface 100 by distance "D" which, as detailed above, preferably ranges between about 0.005 and 0.015 inches. However, in order to eliminate any sharp corner or edge on sealing surface 106, An arcuate, curved surface 119 is used in combination with sloping, angular surface 111, which extends from curved surface 110 to shaft surface 100. Although various arcs or curves may be employed, this embodiment preferably comprises an arcuate surface formed of an arc having a radius of 1.0 inches. By incorporating this construction, a sharp corner is avoided and unwanted tracks or creases are prevented from being formed and sheet 11.

In FIG. 8, an alternate embodiment is depicted which provides a gentle sloping surface which attains an effective transition between sealing surface 106 and shaft surface 100. In this embodiment, roller 22 incorporates a single, angularly disposed sloping surface 112. As shown, surface 112 is constructed to provide a gentle slope angle or transition from sealing surface 106 to shaft surface 100.

In a further alternate embodiment, as depicted in FIG. 9, an arc or radius is formed adjacent each edge of each sealing surface 106 of each inner annular ring 102. In this regard, arcuate surface 114 is formed adjacent each edge of sealing surfaces 106, preferably comprising a radius of about 0.250 inches. In addition, in order to establish a smooth, arcuate gentle transition between sealing surfaces 106 and shaft surface 100, a second arcuate surface 115 is provided having a reverse curvature with a radius of about 0.25 inches. In this way, a smooth, gentle, blended arcuate transition is established between sealing surface 106 and shaft surface 100, preventing the existence of the any sharp corner or edge which could produce a crease on sheet 11 as sheet 11 passes between roller 22 and roller 21.

Figure 5:
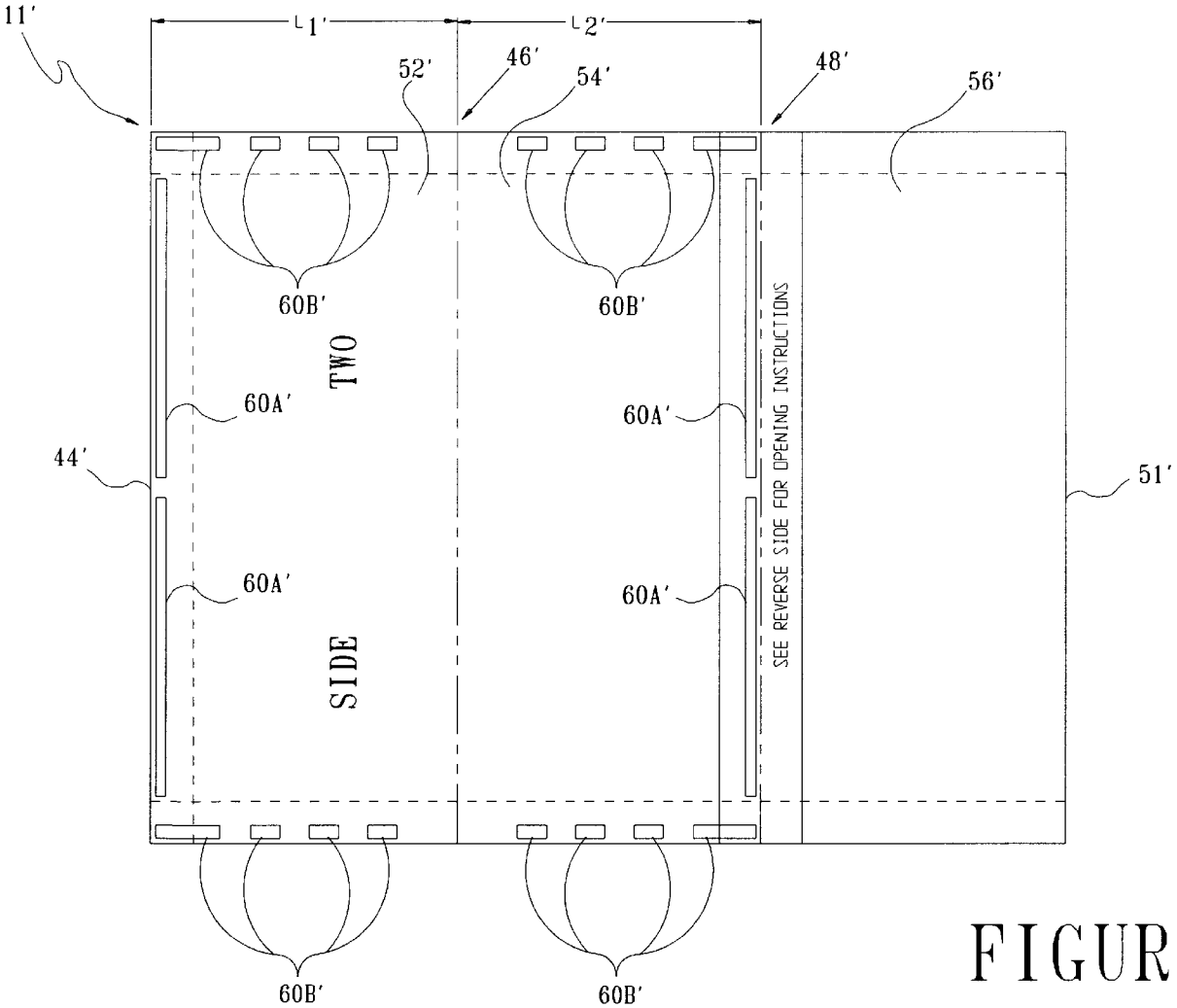
FIG. 5 is a top elevational view of a tri-fold sheet of paper which is alternatively folded and sealed in the apparatus of FIG. 1.

Referring now to FIG. 5, the folder-sealer assembly 10 is also configurable to fold and seal alternate sheets of paper, such as a tri-fold sheet 11'. The tri-fold sheet 11' includes a first perforated line 46' and a second perforated line 48' which divide the sheet into a first sheet segment 52', a second sheet segment 54', and a third sheet segment 56'. To fold the tri-fold sheet 11', the first sheet stop 66 is adjusted to form the first fold at a first perforated fold 46', and the second sheet stop 76 is adjusted to form the second fold at a second perforated fold 48'.

The tri-fold sheet 11' includes patches 60A' of adhesive which are aligned with the sealing surfaces 106 as the folded tri-fold sheet 11' passes between the roller 21 and the roller 22, and patches 60B' which are aligned with the sealing surfaces 108 as the folded tri-fold sheet 11' passes between the roller 21 and the roller 22. As the tri-fold sheet 11' is advanced between the roller 21 and the roller 22, the patches 60A' and the patches 60B' are placed in locations where the paper is three layers thick. In particular, the patches 60A' and 60B' are aligned with portions of the tri-fold sheet 11' which will include the first sheet segment 52', the second sheet segment 54', the third sheet segment 56' 58'. Therefore, the sealing surfaces 108 of the outer annular rings 104 must preferably extend radially the same distance as the sealing surfaces 106 of the inner annular rings 102 to seal the folded tri-fold sheet 11'.

Figure 6A:
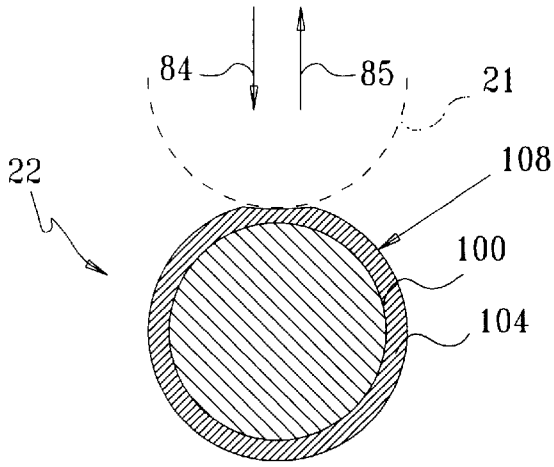
FIG. 6A is a cross sectional view of the second roller as viewed in the direction of the arrows 6A—6A of FIG. 4.

Referring now to FIG. 6A, there is shown a first embodiment of outer annular rings 104 which can accommodate the different requirements of the sheet 11 and the tri-fold sheet 11'. In particular, the outer annular rings 104 are composed of hard urethane which defines a sealing surface 108 which extends radially beyond the sealing surfaces 106 of the inner annular rings 102. Thus, when the second fold is formed in a sheet, such as sheet 11, where the folded sheet 11 has fewer layers proximate to the outer annular rings 104 than the folded sheet 11 has proximate to the inner annular rings 102, the sealing surfaces 108 of the outer annular rings 104 apply the sealing pressure to the patches 60A whereas the sealing surfaces 106 of the inner annular rings 102 apply the sealing pressure to the patches 60B. This is possible because the sealing surfaces 108 of the outer annular rings 104 extend radially beyond the sealing surfaces 106 of the inner annular rings 102, thereby allowing sealing pressure to be applied to both the patches 60A and the patches 60B.

On the other hand, when the second fold is formed in a sheet, such as tri-fold sheet 11', where the folded tri-fold sheet 11' has the same number of layers proximate to the sealing surfaces 106 of the inner annular rings 102 as it does proximate to the sealing surfaces 108 of the outer annular rings 104, the hard urethane of the outer annular ring 104 compresses as shown in FIG. 6A. The compression of the outer annular rings 104 allows the sealing surfaces 106 of the inner annular rings 102 to apply the sealing pressure to the patches 60A' while the sealing surfaces 108 of the compressed outer annular rings 104 applies the sealing pressure to the patches 60B' (see FIG. 5).

Figure 6B:
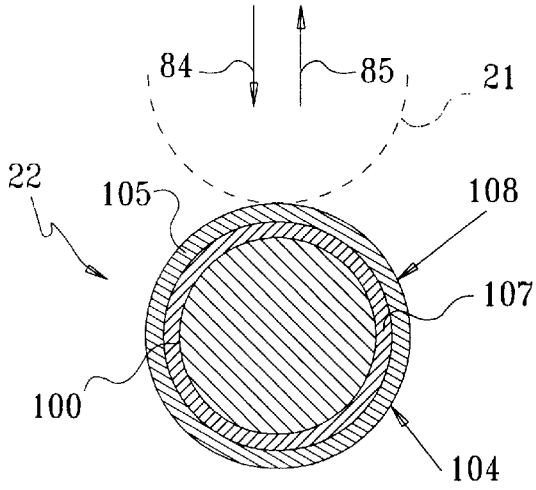
FIG. 6B is a view similar to FIG. 6A, but showing a second embodiment of the second roller.

Referring now to FIG. 6B, there is shown a second embodiment of outer annular rings 104 which can accommodate the different requirements of the sheet 11 and the tri-fold sheet 11'. In particular, the outer annular rings 104 includes a steel ring 105. Soft urethane fills a gap 107 between the steel ring 105 and the roller surface 100. The second embodiment is configured such that the soft urethane in the gap 107 is always compressed on the portion of the outer annular ring 104 positioned proximate to the roller 21. Thus, the soft urethane acts as a spring which urges the steel ring 105 in the general direction of arrow 85 regardless of the number of layers of the sheet 11 between the roller 21 and the roller 22.

When the second fold is formed in a sheet, such as sheet 11, where the folded sheet has fewer layers proximate to the outer annular rings 104 than it has proximate to the inner annular rings 102, the compressed soft urethane in the gap 107 urges the steel ring 105 in the general direction of arrow 85 to apply the sealing pressure to the patches 60B so as to seal the sheet 11. Similarly, when the second fold is formed in a sheet, such as the tri-fold sheet 11', where the folded tri-fold sheet 11' has the same number of layers proximate to the outer annular rings 104 as it has proximate to the inner annular rings 102, the compressed soft urethane in the gap 107 urges the steel ring 105 in the general direction of arrow 85 to apply the sealing pressure to the patches 60B' so as to seal the tri-fold sheet 11'.

In the preferred embodiment of the present invention, roller 22 is constructed with outer annual rings 104 configured as depicted and detailed above in reference to FIG. 6B. Although the embodiment depicted in FIG. 6A can be employed to obtain the ability to seal varying thicknesses, it has been found that over extended time periods, the urethane material often develops permanent deformations or depressions. As a result, outer annual rings 104 can lose their circular shape resulting an inability to function as intended in sealing different thicknesses of material.

In addition, it has also been found that the use of the embodiment depicted in FIG. 6A requires more motor power than the alternate embodiment due to the increased friction between roller 22 and roller 21. Consequently, the preferred construction of roller 22 employs the configuration detailed above in reference to FIG. 6B.

Figure 3E:
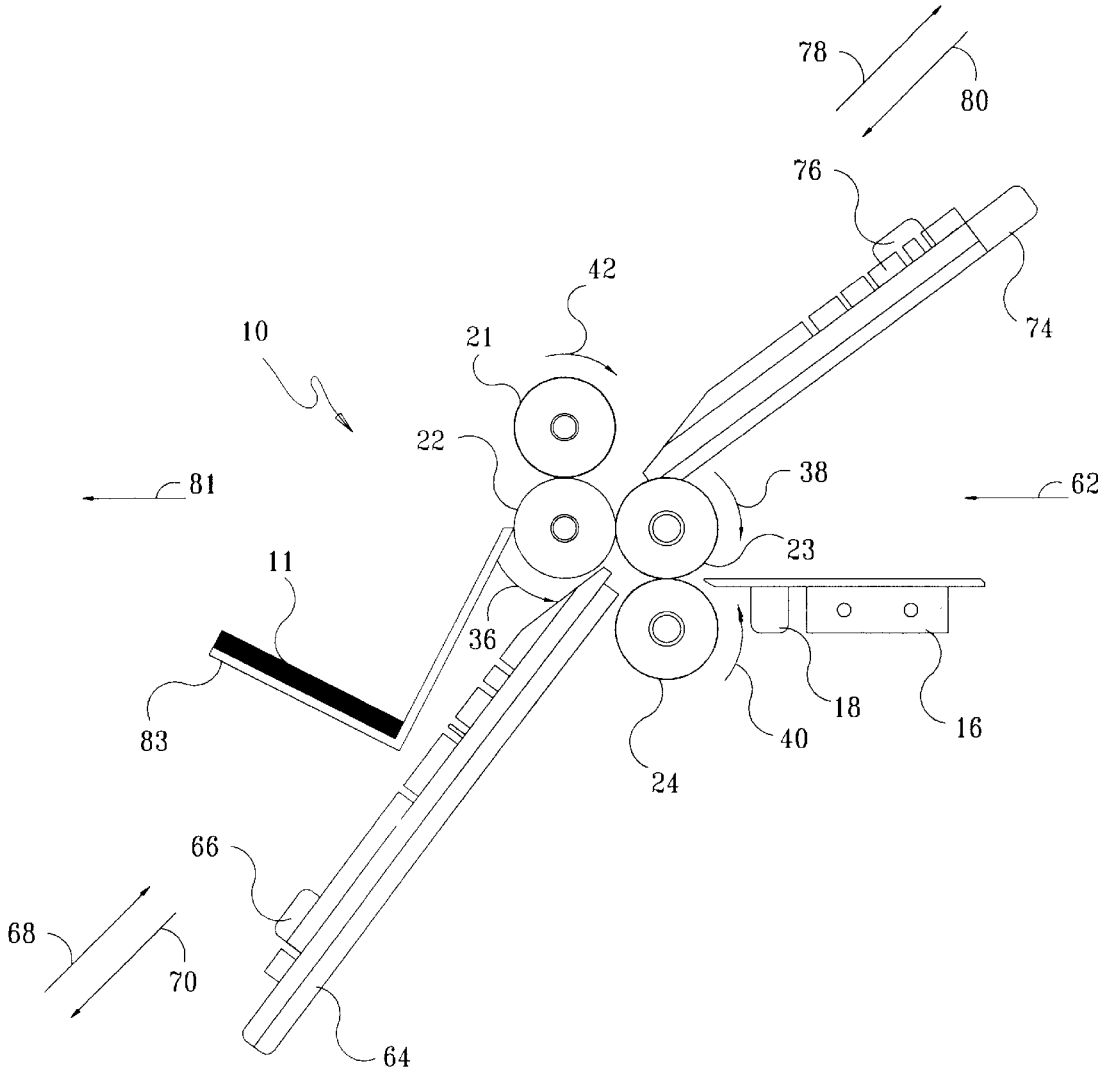
FIG. 3E is a view similar to FIG. 3A, but showing the completed folded and sealed sheet of paper in the exit bin of the folder and sealer apparatus

After the roller 21 and the roller 22 cooperate to place a second fold in the sheet 11 and seal the sheet 11, the rollers 21, 22 advance the folded and sealed sheet 11 in the general direction of arrow 81 as shown in FIG. 3E. After the sheet 11 exits between the roller 21 and the roller 22, the sheet 11 advances to the discharge bin 83.

Another problem which frequently occurs in prior art systems and which is incapable of being satisfactorily resolved is realized when several sheets of paper are to be folded into a single envelope. In this situation, substantially divergent thicknesses of material are obtained and only manual handling has been capable of dealing with these problems. No reasonably priced, dependable prior art automated system has been provided which is capable of folding and automatically sealing several sheets of paper into a single envelope.

By employing the present invention with an alternate construction for annular rings 102, multi-layers of material are capable of being folded and sealed in an envelope using pressure sensitive adhesive zones as detailed above. This alternate embodiment is depicted in FIGS. 10 and 11.

In this embodiment, roller 22 incorporates a plurality of separate and independently driven members 116 mounted on shaft 100. Each member 116 is spaced along the shaft 100 substantially equidistant from each adjacent member 116, while also being constructed for having two alternate positions relative to roller 21.

As depicted, each member 116 comprises a pair of flat surfaces 117 which are in juxtaposed, spaced, parallel relationship with each other and extend between and interconnect curved surfaces 118. In addition, in the preferred construction, surfaces 117 and 118 are formed from steel material and incorporate a urethane core between surfaces 117 and 118 and shaft 100, in order to provide the desired flexibility detailed above in reference to the embodiment of the annular rollers depicted in FIG. 6B.

Figure 10:
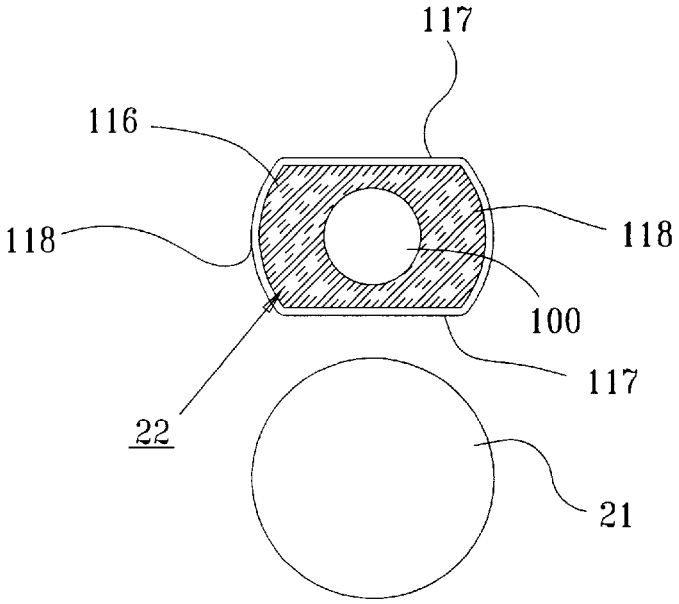
FIG. 10 is a cross-sectional side elevation view depicting a construction for an independently driven member mounted to the second roller and shown in its first, open position.
Figure 11:
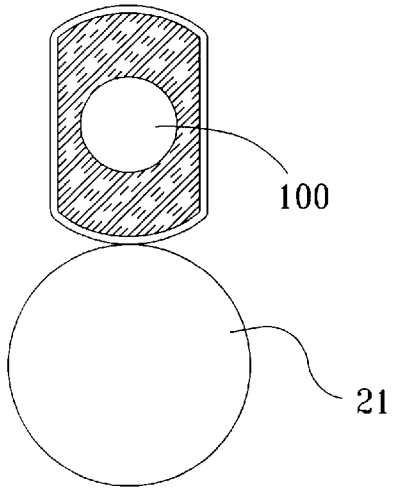
FIG. 11 is a cross-sectional side elevation view of the roller member of FIG. 10 shown in its second, closed position.
Figure 12:
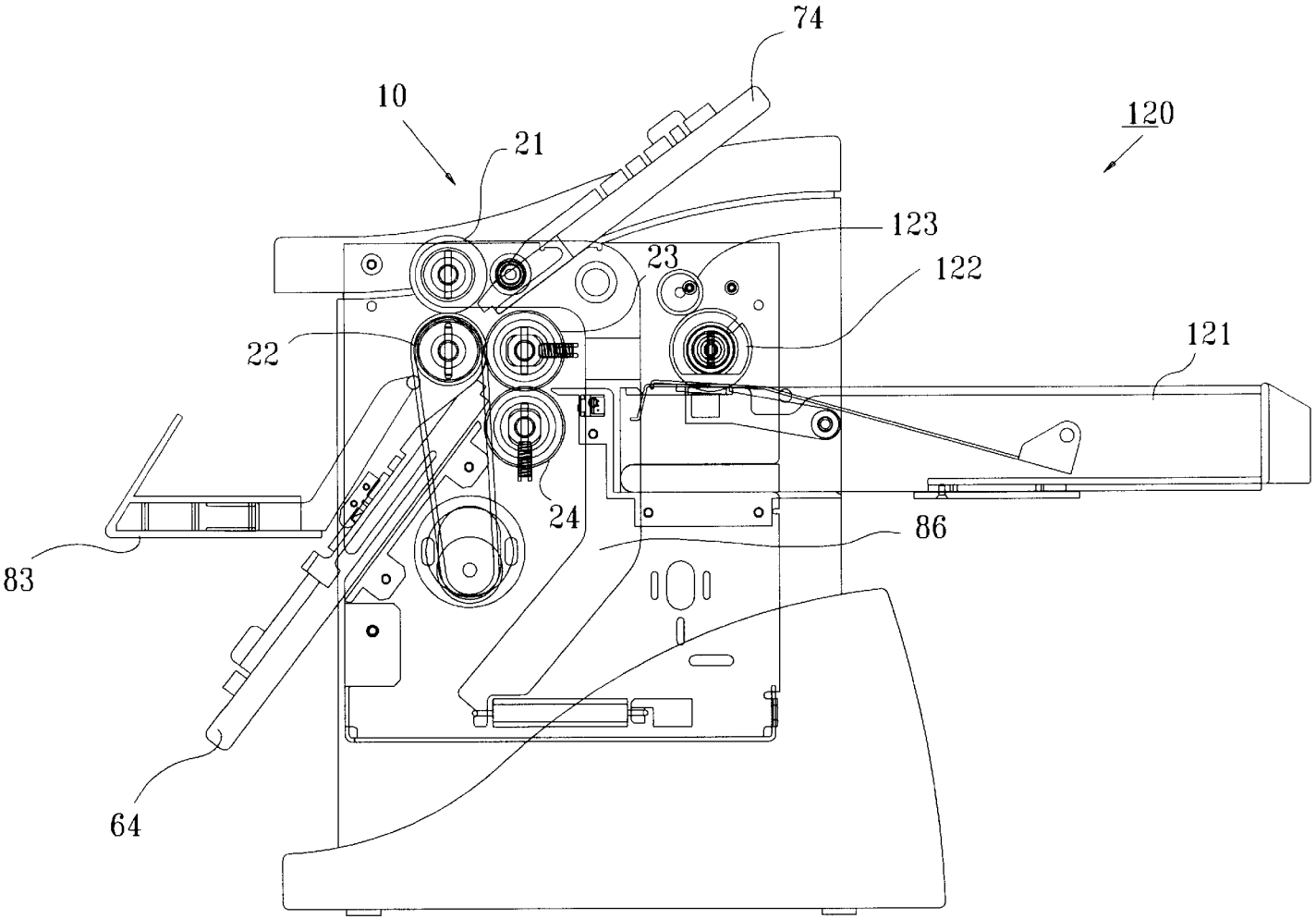
FIG. 12 is a side elevation view of a separate, independent folding system incorporating the folding and sealing apparatus of FIG. 1.

As a result of this configuration, member 116 forms an enlarged gap between shaft 100 and roller 21 when in its first position, as depicted in FIG. 10, while also having a second, alternate position, depicted in FIG. 11, wherein curved surface 118 is in direct contact with roller 21. By employing this construction and controlling a rotational movement of member 116 on shaft 100, member 116 is maintained in its first position whenever substantial thicknesses of folded sheets must pass between roller 21 and roller 22. In this way, multi-layers of folded material are capable of easily moving there-between.

However, whenever adhesive zones or patches are to be sealed in order to securely retain the folded sheets of material within the envelope being formed, members 116 are rotated into their second position, as depicted in FIG. 11. In this second position, direct contact between curved surfaces 118 and roller 21 is provided and any adhesive zones passing therebetween are compressed in order to assure sealing of the adhesive patches with the particular sheets of material on which the patches are associated.

By employing this embodiment of the present invention, the prior art inability to handle multilayer sheets of material on an automated basis has been overcome. In addition, a roller construction is obtained which is capable of folding and sealing sheets of paper in an envelope regardless of the quantity of sheets to be folded and sealed therein.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although the folder-sealer assembly 10 is described as having the roller 21 positioned over the roller 22, and the lever arm 86 being biased directly against the roller 21, and this arrangement has significant advantages thereby, it should be appreciated that the roller 22 may be switched with the roller 21 so that the roller 22 would assume the position of roller 21, and the roller 21 would assume the position of roller 22. In this arrangement, the roller 22 would be positioned over the roller 21, and the lever arm 86 would be biased directly against the roller 22.

In addition, it should be appreciated that a guide member may be positioned over the chute 64 in order to ensure that the sheet 11 buckles only at the perforated line 48. Also, it should be appreciated that another guide member may be positioned over the chute 74 in order to ensure that the sheet 11 buckles only at the perforated lines 46, 50. Note that if a guide member was not positioned over the chute 64, it is possible that the sheet 11 may buckle at the perforated line 46 during advancement of the sheet 11 against the stop 66. In any event, providing guide members over the chutes 64, 74 facilitates proper advancement of the sheet 11 within the folder-sealer assembly 10.

In the foregoing detailed discussion the apparatus of the present invention was described in combination with a conventional printer, for receiving printed sheets exiting from the printer and automatically folding the printed sheet of material as detailed above. However, as depicted in FIG. 9, the present invention can also been implemented as an independent, free-standing folding machine 120. In this embodiment, folding machine 120 comprises a paper holding cassette 121 within which a stack of pre-printed sheets 11 are maintained. Then, using conventional sheet feeding technology, sheets 11 are fed individually from cassette 121 by feed roller 122, which is driven by feed motor 123, onto feed tray 16 and photo sensor 18 associated therewith. The remainder of folder-sealer assembly 10 is employed, and is constructed in a manner substantially identical to the construction discussed and detailed above.

By employing this construction, a free-standing sheet folding machine is obtained which is capable of converting pre-printed sheets of paper into completely folded, sealed, and stacked envelopes ready for mailing. As a result, large scale mailing runs such as bills, checks, advertising literature and the like, are all capable of being printed and quickly and easily folded and sealed into an envelope configuration, ready for mailing. In this way, substantial time and expense is saved and an otherwise tedious job is eliminated.

It will thus be seen that the objects set forth above, among those made apparent from preceding description, are efficiently attained and, since certain changes may be made in the above constructions without departing from the scope of the invention, it is intended that all matter contained in the above description or shown in the accompanying drawings shall be interpreted as illustrative and not a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desired to secure by Letters Patent is:

1. A system for receiving printed sheets having adhesive bearing zones formed thereon and for folding and sealingly closing the sheets into envelope products comprising:

A. receiving means for receiving a printed sheet having adhesive bearing zones formed thereon and advancing the sheet into a first receiving zone;

B. the first receiving zone incorporating movably adjustable stop means for preventing the advance of the sheet therein when desired and causing said sheet to buckle along a desired location on said sheet;

C. a first roller and a second roller mounted in juxtaposed, spaced, cooperating relationship for forming a second sheet receiving zone therebetween, positioned for receiving the buckled edge of the sheet and causing the sheet to be folded as the sheet moves between the rollers;

D. a plurality of radially extending annular protrusions a. formed on said first roller, b. positioned for forming contact surfaces with said second roller and positioned for directly engaging the adhesive zones as said zones pass between the first and second rollers, and c. said contact surfaces comprising a total annular contact surface area which ranges between 10% and 20% of the entire annular surface area of said first roller, whereby frictional surface engagement between the first roller and the second roller is substantially reduced while providing the required engagement for activating the adhesive zones.

2. The sheet folding and sealing system defined in claim 1, wherein said protrusions are further defined as comprising annular shaped ring members radially extending from the roller surface a distance ranging between 0.005 inches and 0.025 inches.

3. The sheet folding and sealing system defined in claim 2, wherein said protrusions are further defined as comprising a pair of end mounted annular ring members formed at the terminating ends of the roller and a plurality of ring members formed intermediate to the pair of end mounted annular ring members, with said intermediate ring members being formed on said roller surface equidistant from each other.

4. The sheet folding and sealing system defined in claim 3, wherein said end mounted annular ring members are further defined as being formed on said roller surface radially extending therefrom a distance ranging between 0.015 inches and 0.025 inches.

5. The sheet folding and sealing system defined in claim 4, wherein said intermediate mounted annular ring members are defined as being formed on said roller surface radially extending therefrom a distance ranging between 0.005 inches and 0.015 inches.

6. The sheet folding and sealing system defined in claim 5, wherein said intermediate mounted annular ring members are further defined as being formed on said roller surface radially extending therefrom a distance of 0.010 inches and said end mounted annular ring members are defined as being formed on said roller surface radially extending therefrom a distance of 0.020 inches.

7. The sheet folding and sealing system defined in claim 3, wherein said intermediate annular ring members are further defined as comprising between two and four separate independent members.

8. The sheet folding and sealing system defined in claim 7, wherein four separate and independent intermediate ring members are formed on the roller surface.

9. The sheet folding and sealing system defined in claim 8, wherein said total annular contact surface area is further defined as ranging between 12% and 18.5% of the entire annular surface area of said roller.

10. The sheet folding and sealing system defined in claim 3, wherein said end mounted annular ring members are further defined as comprising compressible material for enabling the ring members to flexibly compress depending upon the thickness of the material passing therebetween.

11. The sheet folding and sealing system defined in claim 10, wherein said end mounted annular ring members are further defined as comprising compressible material formed therebetween the roller surface and an outer layer of steel material, assuring contact between the sheet and the second roller with a solid steel surface capable of flexing due to the intermediate compressible material.

* * * * *